US010545455B2

(12) United States Patent
Yamaguchi

(10) Patent No.: US 10,545,455 B2
(45) Date of Patent: Jan. 28, 2020

(54) PROCESS CARTRIDGE AND IMAGE FORMING APPARATUS INCLUDING THE SAME

(71) Applicant: SHARP KABUSHIKI KAISHA, Sakai, Osaka (JP)

(72) Inventor: Jun Yamaguchi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/450,086

(22) Filed: Jun. 24, 2019

(65) Prior Publication Data

US 2019/0391527 A1 Dec. 26, 2019

(30) Foreign Application Priority Data

Jun. 25, 2018 (JP) ..... 2018-120156

(51) Int. Cl.
*G03G 21/18* (2006.01)
*G03G 21/16* (2006.01)

(52) U.S. Cl.
CPC ..... *G03G 21/1842* (2013.01); *G03G 21/18* (2013.01); *G03G 21/1803* (2013.01); *G03G 21/1814* (2013.01); *G03G 21/1817* (2013.01); *G03G 21/1821* (2013.01); *G03G 21/1825* (2013.01); *G03G 21/1839* (2013.01); *G03G 21/1671* (2013.01); *G03G 21/1676* (2013.01)

(58) Field of Classification Search
CPC ..... G03G 21/1671; G03G 21/1676; G03G 21/18; G03G 21/1803; G03G 21/1814; G03G 21/1817; G03G 21/1821; G03G 21/1825; G03G 21/1839; G03G 21/1842
See application file for complete search history.

(56) References Cited

U.S. PATENT DOCUMENTS 9,122,240 B2 * 9/2015 Hashimoto ..... G03G 21/1853
2009/0297216 A1 * 12/2009 Kawai ..... G03G 21/1825 399/111

FOREIGN PATENT DOCUMENTS

EP 2182413 A2 * 5/2010 ..... G03G 21/1825
JP 2013-025063 A 2/2013

* cited by examiner

*Primary Examiner* — Joseph S Wong
(74) *Attorney, Agent, or Firm* — ScienBiziP, P.C.

(57) ABSTRACT

A process cartridge includes a photoconductor unit and a development unit, which are assembled together while being allowed to be separated from each other. The photoconductor unit and the development unit include fitting portions that fix positions of the units to assemble the units, assembly guides that guide the units to an assembly position, and stopper portions that hold the units in the assembly position.

10 Claims, 11 Drawing Sheets

PROCESS CARTRIDGE AND IMAGE FORMING APPARATUS INCLUDING THE SAME

BACKGROUND

1. Field

The present disclosure relates to a process cartridge, and an image forming apparatus including the process cartridge. The present disclosure particularly relates to, for example, a process cartridge and an image forming apparatus including the process cartridge, the process cartridge including a photoconductor unit and a development unit assembled together while being allowed to be separated from each other, the process cartridge being attached to and removed from an apparatus body of an image forming apparatus while the units are assembled together, the photoconductor unit including a photoconductor drum, and the development unit including the development roller.

2. Description of the Related Art

Japanese Unexamined Patent Application Publication No. 2013-25063 discloses an example of an existing image forming apparatus. The image forming apparatus disclosed in Japanese Unexamined Patent Application Publication No. 2013-25063 includes a process cartridge attachable to or removable from the body. The process cartridge at least includes a photoconductor unit, which holds a photoconductor, and a development unit assembled with the photoconductor unit. The process cartridge is attached to or removed from the body while being in the assembled state. The body also includes a support portion, which supports the process cartridge removed from the body without touching the photoconductor. When removed from the body, the process cartridge can be disassembled into and reassembled from the photoconductor unit and the development unit on the support portion.

The technology described in Japanese Unexamined Patent Application Publication No. 2013-25063 includes assembly of the photoconductor unit and the development unit by screwing a side plate. Thus, the screws need to be removed using a screwdriver to disassemble the process cartridge into the photoconductor unit and the development unit for maintenance or other purposes, which consumes time and effort. Similarly, assembling also consumes time and effort. Thus, the technology described in Japanese Unexamined Patent Application Publication No. 2013-25063 exerts a heavy load on a user, and the maintenance requires improvement.

The present disclosure aims to provide a new process cartridge and an image forming apparatus including the process cartridge.

The present disclosure also aims to provide a process cartridge including a photoconductor unit and a development unit that are assembled together while being allowed to be separated from each other with a simple operation, and an image forming apparatus including the photoconductor unit.

SUMMARY

According to a first aspect of the disclosure, there is provided a process cartridge including a photoconductor unit and a development unit assembled with the photoconductor unit while being allowed to be separated from the photoconductor unit, the process cartridge being attachable to and removable from an apparatus body of the image forming apparatus in an assembled state. The photoconductor unit includes a photoconductor drum. The development unit includes a development roller. In the first aspect, the photoconductor unit and the development unit include fitting portions, assembly guides, and stopper portions. The fitting portions are fitted to each other in the axial direction of the photoconductor drum to fix positions of the photoconductor unit and the development unit and assemble the photoconductor unit and the development unit together. The assembly guides are engaged together while being slidably movable in the axial direction, and guide the photoconductor unit and the development unit to an assembly position, that is, to a position at which the fitting portions are fitted together. When the fitting portions are fitted together, the stopper portions restrict the photoconductor unit and the development unit while allowing the photoconductor unit and the development unit to move relative to each other in the axial direction (more specifically, prevent the units from being detached from each other). In the process cartridge, the fitting portions are fitted together as a result of, for example, sliding the photoconductor unit over the development unit while the assembly guides are engaged together, so that the photoconductor unit and the development unit are assembled together. When operated reversely, the process cartridge is disassembled into the photoconductor unit and the development unit.

A tenth aspect relates to an image forming apparatus, which includes the process cartridge according to any one of the first to ninth aspects and an apparatus body including a cartridge receiving portion to which the process cartridge is removably attached.

DESCRIPTION OF THE EMBODIMENTS

First Embodiment

Figure 1:
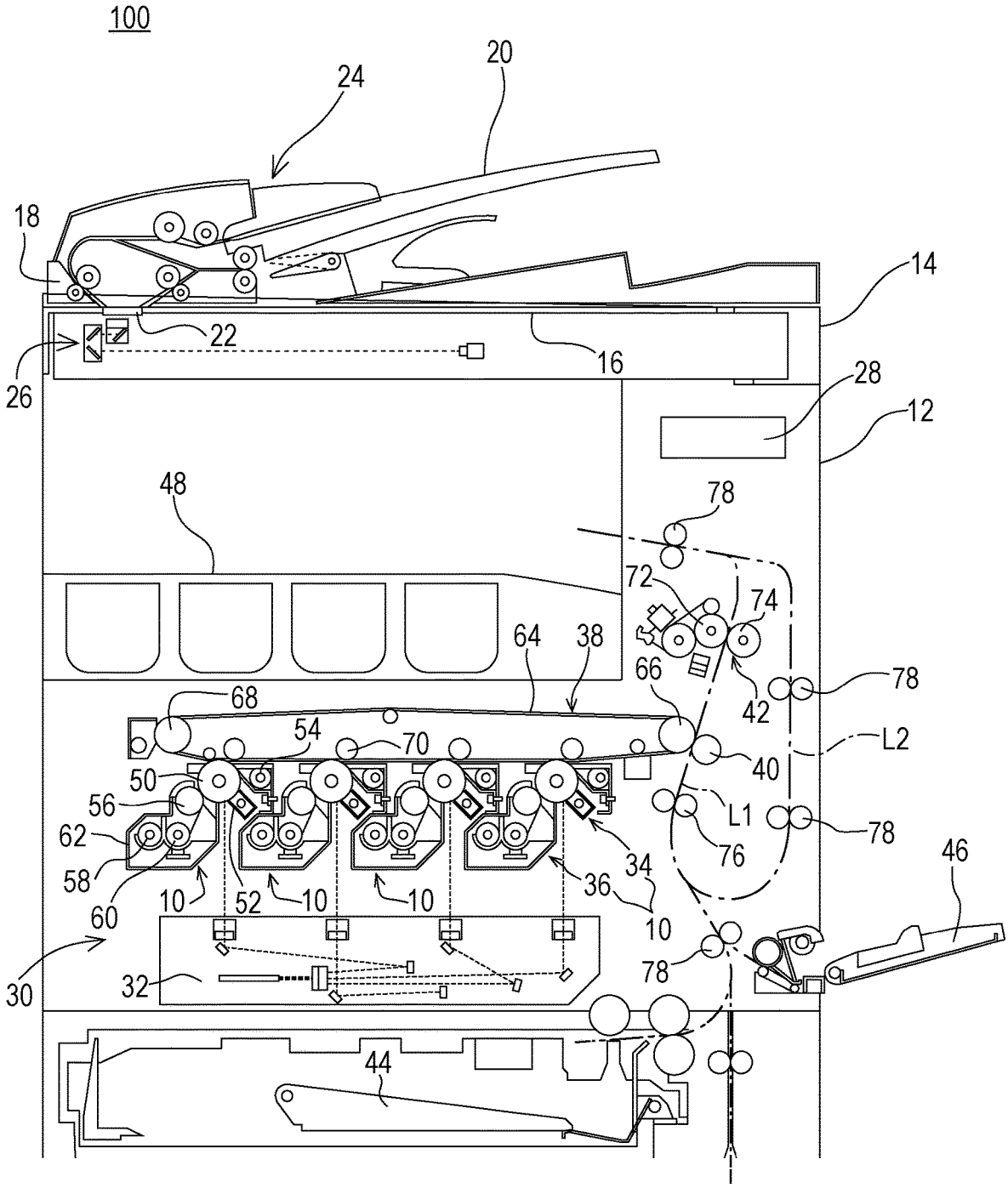
FIG. 1 is a schematic cross-sectional view of the internal structure of an image forming apparatus including a process cartridge according to a first embodiment of the present disclosure.
Figure 2:
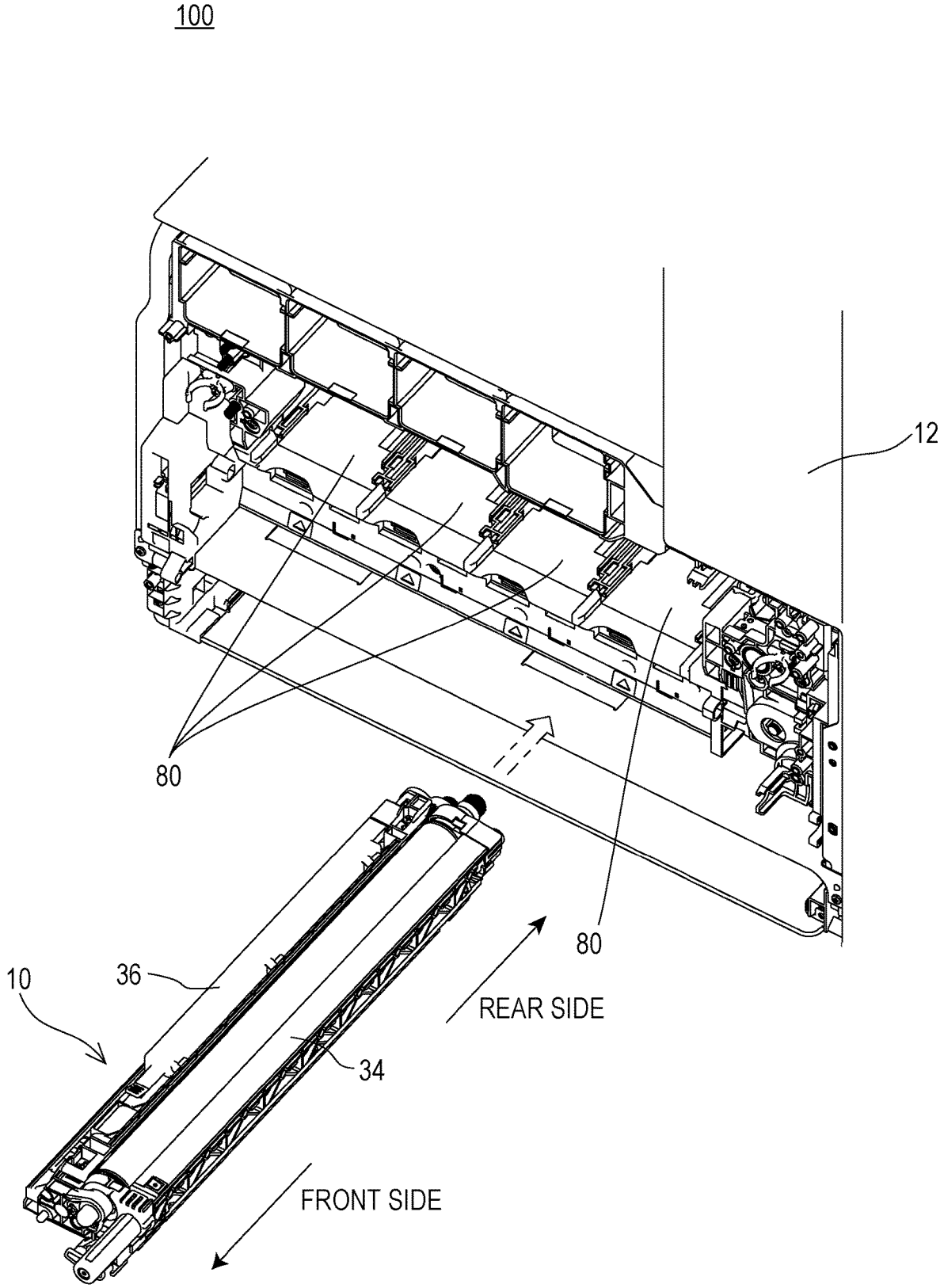
FIG. 2 illustrates a process cartridge and an apparatus body of an image forming apparatus.

With reference to FIG. 1 and FIG. 2, process cartridges 10 according to a first embodiment of the present disclosure are included in an image forming apparatus 100, which forms multi-color or monochrome images on sheets (recording media) with electrophotography. As will be described in detail later, each process cartridge 10 includes a photoconductor unit 34, which includes components such as a photoconductor drum 50, and a development unit 36, which includes components such as a development roller 56. While the photoconductor unit 34 and the development unit 36 are fixed in position and assembled together, the process cartridge 10 is attached to and removed from (drawn into or out of) an apparatus body 12 of the image forming apparatus 100 in the longitudinal direction of the process cartridge 10. While being removed from the apparatus body 12, the process cartridge 10 is allowed to be disassembled into the photoconductor unit 34 and the development unit 36 with a simple operation, and then assembled together with a simple operation.

Firstly, a basic structure of the image forming apparatus 100 is schematically described. In this embodiment, the image forming apparatus 100 is a multifunction peripheral (MFP) including functions such as a copier function, a printer function, a scanner function, and a facsimile function.

In this description, a front-rear direction (depth direction) of the image forming apparatus 100 and its components is defined with the surface of the image forming apparatus 100 facing a user standing while operating the image forming apparatus 100 being defined as a front surface, that is, the surface on which an operation portion such as a touch screen is disposed being defined as a front surface, and a left-right direction (lateral direction) of the image forming apparatus 100 and its components is defined based on the view from the user viewing the image forming apparatus 100.

As illustrated in FIG. 1, the image forming apparatus 100 includes an apparatus body 12, which includes components such as an image forming unit 30, and an image reading device 14 disposed on the apparatus body 12.

The image reading device 14 includes a document receiving table 16, made of a transparent material. A document holding cover 18 is attached over the document receiving table 16 to be openable or closeable with a component such as a hinge. An automatic document feeder (ADF) 24, which automatically feeds documents mounted on a document mount tray 20 one by one to an image reading position 22, is disposed on the document holding cover 18. Although not illustrated, an operation portion including components such as a touch screen and operation buttons that receive input operations from a user such as a print instruction is disposed on the front side of the document receiving table 16.

The image reading device 14 includes an image reading unit 26, which includes components such as a light source, multiple mirrors, an image-forming lens, and a line sensor. The image reading unit 26 guides reflection light to the image-forming lens using the multiple mirrors, the reflection light being emitted from the light source to expose the document surface with the light and then being reflected off the document surface. The image-forming lens condenses the reflection light to form an image on light receiving elements of the line sensor. The line sensor detects luminance or hue of the reflection light condensed on the light receiving elements, and forms image data based on the image on the document surface. Examples usable as a line sensor include a charge coupled device (CCD) and a contact image sensor (CIS).

The apparatus body 12 includes components such as a control unit 28, including components such as CPU or a memory, and the image forming unit 30. The control unit 28 transmits control signals to each component of the image forming apparatus 100 in accordance with input operations performed on the operation portion such as the touch screen, to cause the image forming apparatus 100 to perform a variety of operations.

The image forming unit 30 includes components such as a light exposure unit 32, photoconductor units 34, development units 36, an intermediate transfer belt unit 38, a transfer roller 40, and a fixing unit 42. The image forming unit 30 forms images on sheets transported from a sheet feed tray 44 or a manual sheet feed tray 46, and discharges sheets on which images have been formed to a sheet discharge tray 48. Examples of image data used to form images on sheets include image data read by the image reading unit 26 and image data transmitted from external computers.

Here, the process cartridge 10 includes two subunits, that is, the photoconductor unit 34 and the development unit 36, that are assembled together while being allowed to be separated from each other. While these subunits are fixed in position and assembled together, the process cartridge 10 is drawn into and out of a cartridge receiving portion 80 from the front side of the apparatus body 12 (refer to FIG. 2).

Image data operated by the image forming apparatus 100 corresponds to color images of four colors, that is, black (K), cyan (C), magenta (M), and yellow (Y). Thus, four process cartridges 10 are attached to the apparatus body 12 to form four types of latent image corresponding to the respective colors, and the process cartridges 10 constitute four image stations. The four process cartridges 10 are arranged in a line in the horizontal direction, parallel to the direction in which the surface of an intermediate transfer belt 64 moves.

The light exposure unit 32 is formed as a laser scanning unit (LSU) including components such as a laser emitting unit and a reflection mirror. The light exposure unit 32 exposes the surface of the charged photoconductor drum 50 to light to form an electrostatic latent image corresponding to the image data on the surface of the photoconductor drum 50. The laser beam emitted from the light exposure unit 32 arrives at the photoconductor drum 50 through a gap between assembly guides disposed at the front end portion and the rear end portion of the process cartridge 10, described later.

Each photoconductor unit 34 includes components such as a photoconductor drum 50, a charging device 52, and a cleaner unit 54. The photoconductor drum 50 is an electrostatic latent image carrier including a photoconductor layer on the surface of an electroconductive cylindrical base. The photoconductor drum 50 is rotatable about an axis by a driving unit, not illustrated. The charging device 52 is a member that charges the surface of the photoconductor drum 50 to a predetermined potential. The cleaner unit 54 includes components such as a cleaning blade. After the toner image is transferred to the intermediate transfer belt 64, the cleaner unit 54 removes toner remaining on the surface of the photoconductor drum 50 to reclaim the toner.

Each development unit 36 renders the electrostatic latent image formed on the surface of the photoconductor drum 50 visible (forms a toner image) with toner of four colors (YMCK), and includes components such as the development roller 56, which feeds toner to the photoconductor drum 50, and transport members 58 and 60. The development roller 56 is disposed adjacent to and parallel to the photoconductor drum 50, and rotatable about the axis by a driving unit, not illustrated. A development housing 62 of the development unit 36 accommodates a developer containing toner and a carrier. The toner contained in the developer is fed to the photoconductor drum 50 via the development roller 56.

The intermediate transfer belt unit 38 includes components such as an intermediate transfer belt 64, a driving roller 66, a driven roller 68, and four intermediate transfer rollers 70, and is disposed over the photoconductor drums 50. The intermediate transfer belt 64 is disposed in contact with the photoconductor drums 50. When the intermediate transfer rollers 70 sequentially transfer toner images of the respective colors on the respective photoconductor drum 50 to the intermediate transfer belt 64 one on another, a multicolor toner image is formed on the intermediate transfer belt 64. The transfer roller 40 is disposed adjacent to the driving roller 66. When a sheet passes through a nip area between an intermediate transfer belt 64 and the transfer roller 40, a toner image on the intermediate transfer belt 64 is transferred to the sheet.

The fixing unit 42 includes a heat roller 72 and a pressing roller 74, and is disposed above the transfer roller 40. The heat roller 72 is retained at a predetermined fixing temperature. When a sheet passes through a nip area between the heat roller 72 and the pressing roller 74, the toner image transferred to the sheet melts, is mixed, and is pressed to be thermally fixed to the sheet.

In the apparatus body 12, a first sheet transport passage L1 is formed to transport sheets from the sheet feed tray 44 or the manual sheet feed tray 46 to the sheet discharge tray 48 via registration rollers 76, the transfer roller 40, and the fixing unit 42. In addition, a second sheet transport passage L2 is formed upstream of the transfer roller 40 in a sheet transport direction to return, to the first sheet transport passage L1, a sheet that has been subjected to single-side printing and that has passed through the fixing unit 42 to perform double-sided printing on the sheet. On the first sheet transport passage L1 and the second sheet transport passage L2, multiple transport rollers 78 are provided as appropriate to exert an auxiliary propulsive force on the sheet.

When the apparatus body 12 performs single-side printing (image forming), sheets mounted on the sheet feed tray 44 or the manual sheet feed tray 46 are guided to the first sheet transport passage L1 one by one, and transported to the registration rollers 76 by the transport rollers 78. The registration rollers 76 transport the sheet to the transfer roller 40 at the timing at which the leading end of the sheet coincides with the leading end of image information on the intermediate transfer belt 64 to allow the toner image to be transferred to the sheet. Thereafter, when the sheet passes through the fixing unit 42, unfixed toner on the sheet melts with heat to be fixed on the sheet. Then, the sheet passes by transport rollers (sheet discharge rollers) 78 and is discharged onto the sheet discharge tray 48.

To perform double-side printing, on the other hand, when a sheet that has been subjected to single-side printing and that has passed through the fixing unit 42 has its trailing end portion arriving at the transport rollers 78 adjacent to the sheet discharge tray 48, the sheet is reversely transported with reverse rotation of the transport rollers 78 to be guided to the second sheet transport passage L2. The sheet guided to the second sheet transport passage L2 is transported along the second sheet transport passage L2 to be guided to the first sheet transport passage L1 upstream of the registration rollers 76 in the sheet transport direction. In this operation, the sheet is turned upside down. Thereafter, while the sheet passes by the transfer roller 40 and the fixing unit 42, the sheet is subjected to printing on the rear side.

Figure 3:
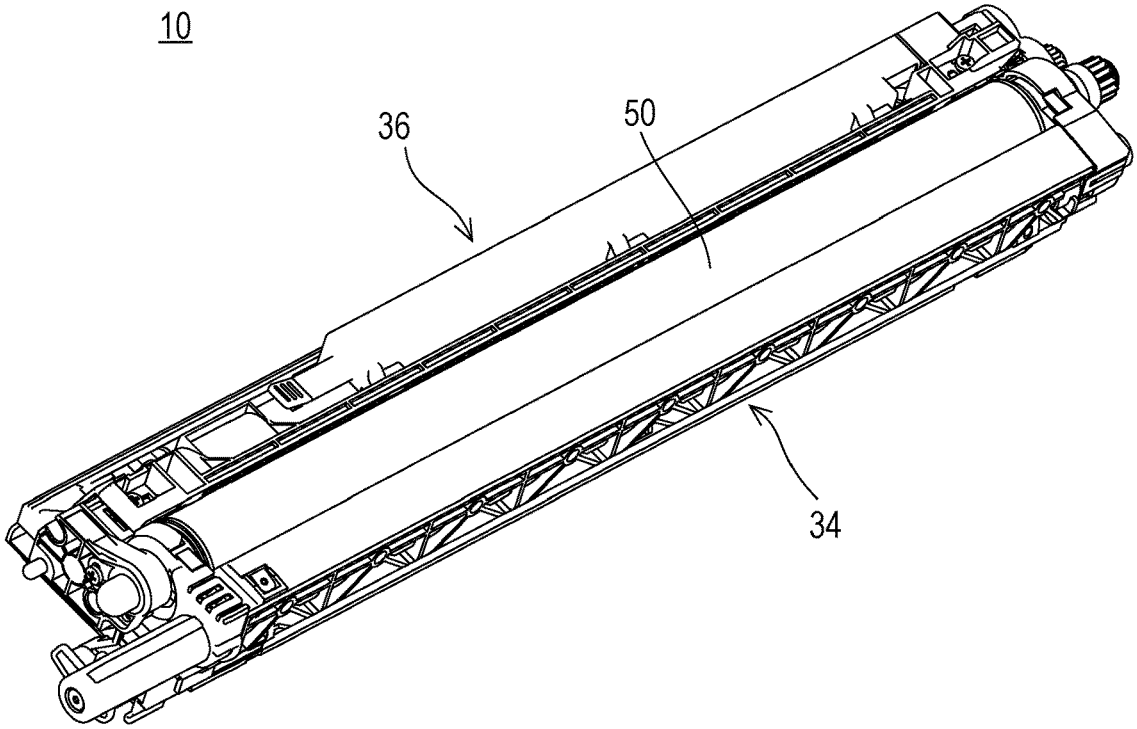
FIG. 3 is a perspective view of the process cartridge according to the first embodiment of the present disclosure.
Figure 4:
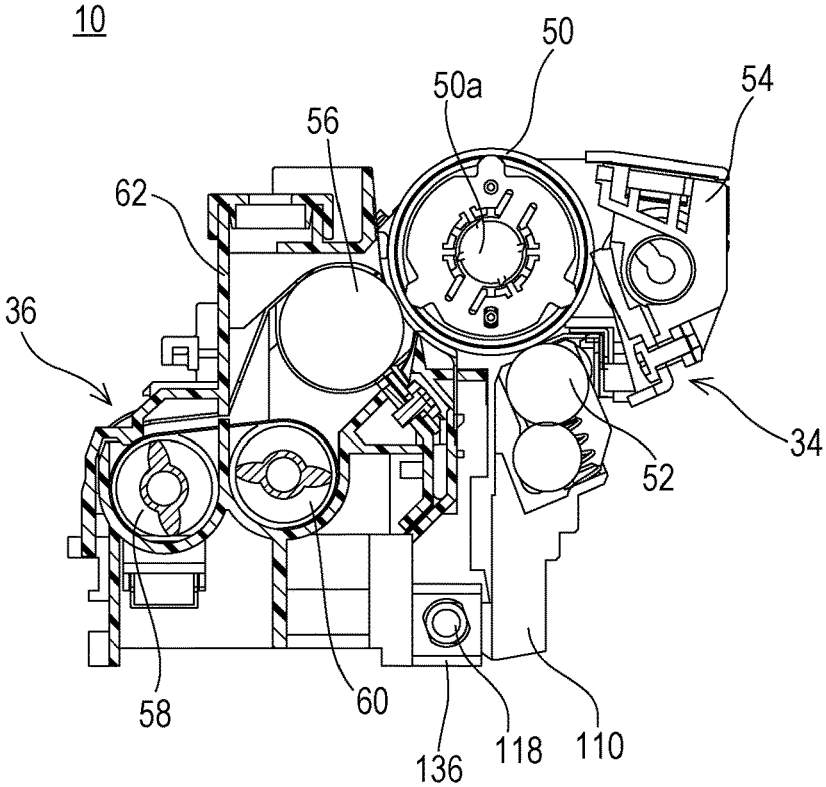
FIG. 4 is a schematic cross-sectional view of the process cartridge illustrated in FIG. 3.

Subsequently, the structure of the process cartridge 10 will be described. As illustrated in FIG. 3 and FIG. 4, the process cartridge 10 includes the photoconductor unit 34 and the development unit 36 assembled together while being allowed to be separated from each other. Each process cartridge 10 is attached to and removed from a corresponding one of cartridge receiving portions 80 (refer to FIG. 2) of the apparatus body 12 while the photoconductor unit 34 and the development unit 36 are fixed in position and assembled together. The photoconductor unit 34 and the development unit 36, which are attached to and removed from the apparatus body 12 while being assembled together enables size reduction of the apparatus body 12. An attachment or removal of the assembled photoconductor unit 34 and development unit 36 as in the embodiment enables size reduction of the apparatus body 12 because the apparatus body 12 does not need a guide space, unlike a large-sized apparatus body of an image forming apparatus to which the photoconductor unit and the development unit are individually attached, the large-sized apparatus body requiring a guide space secured between the photoconductor drum and the development unit for attachment and removal of the development unit to prevent the photoconductor drum from being damaged.

Here, in view of maintainability or other effects, the process cartridge 10 is preferably separated into the photoconductor unit 34 and the development unit 36 with a simple operation, and assembled from these units with a simple operation. The process cartridge 10 according to the first embodiment thus has the following structure. Specifically, the photoconductor unit 34 and the development unit 36 constituting the process cartridge 10 have fitting portions, assembly guides, and stopper portions to enable assembly and disassembly of the process cartridge 10 with a simple operation. This structure will be described in detail, below.

Figure 5:
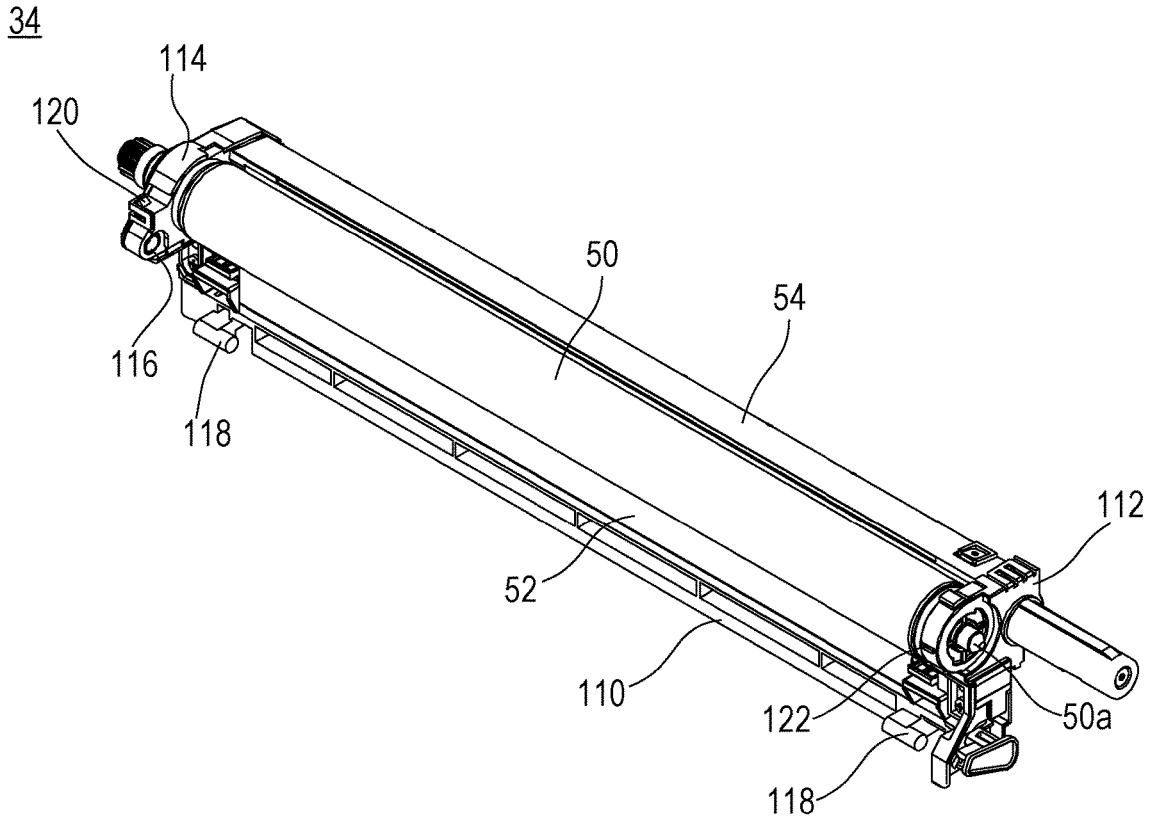
FIG. 5 is a perspective view of a photoconductor unit included in the process cartridge illustrated in FIG. 3.
Figure 6:
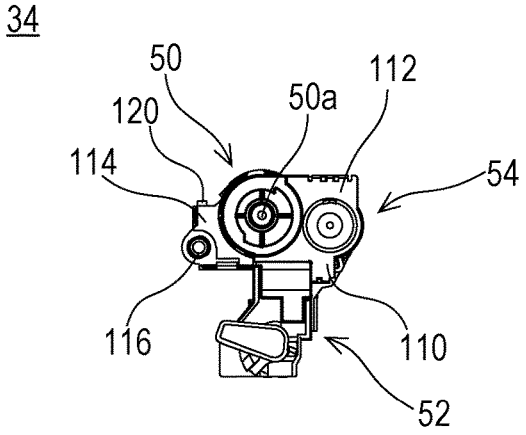
FIG. 6 is a front view of the photoconductor unit illustrated in FIG. 5.
Figure 7:
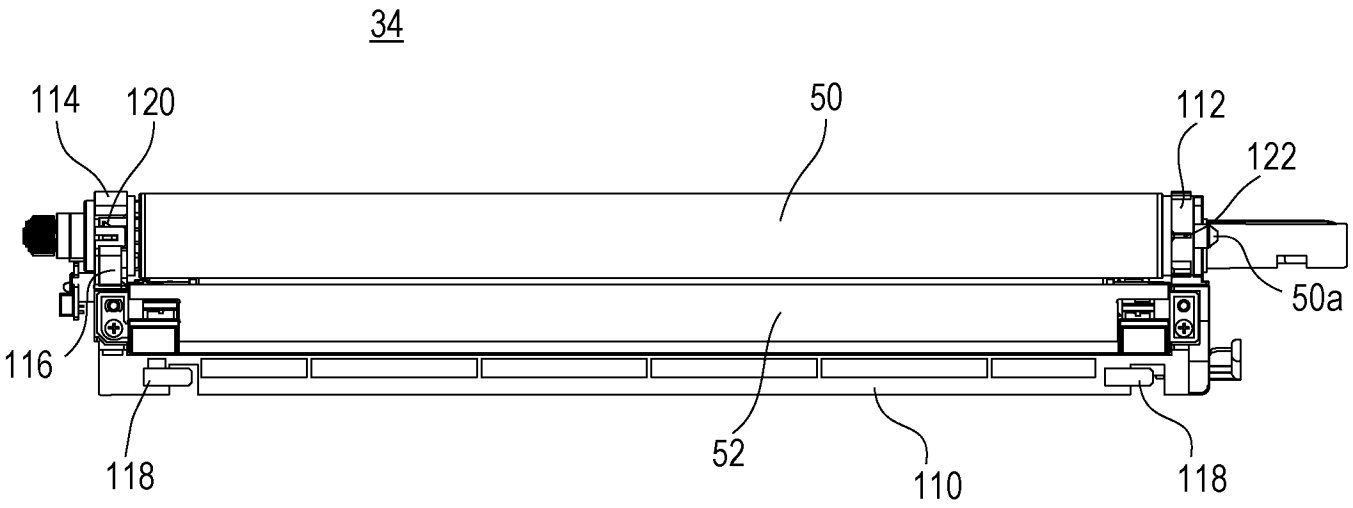
FIG. 7 is a left side view of the photoconductor unit illustrated in FIG. 5.
Figure 8:
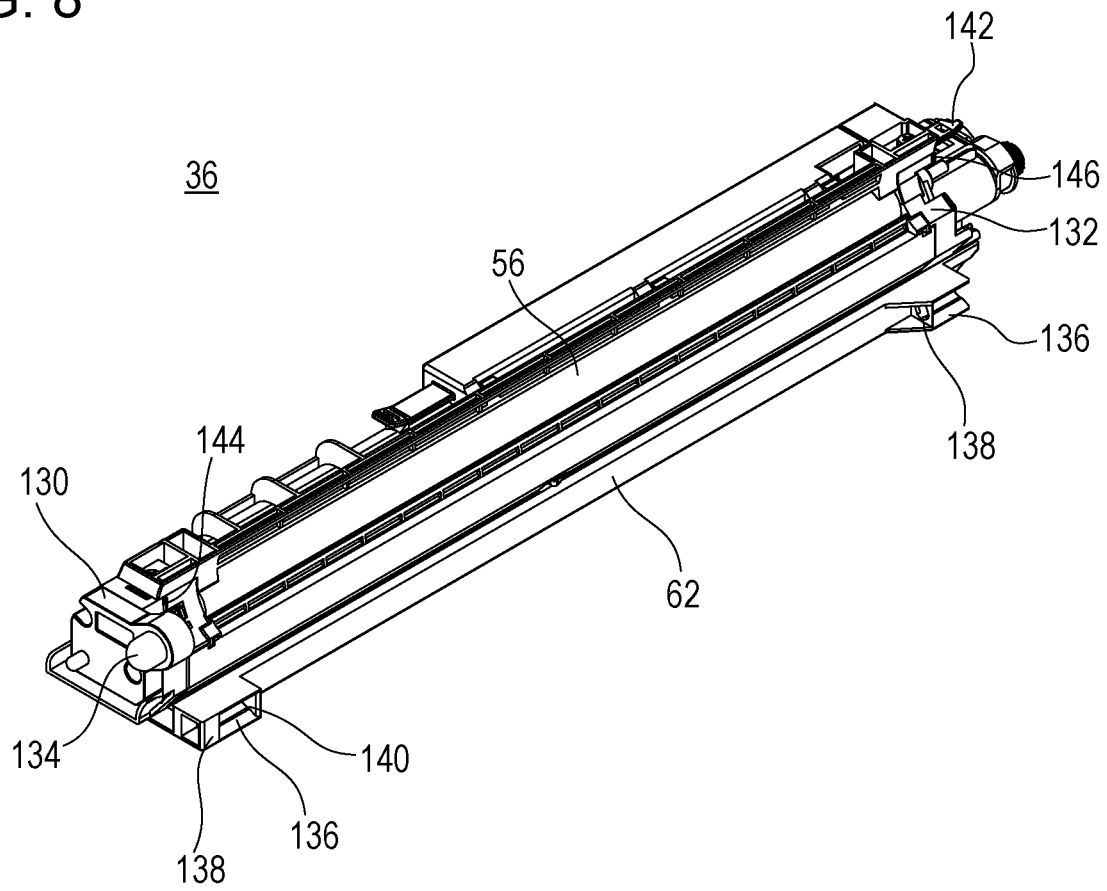
FIG. 8 is a perspective view of a development unit included in the process cartridge illustrated in FIG. 3.
Figure 9:
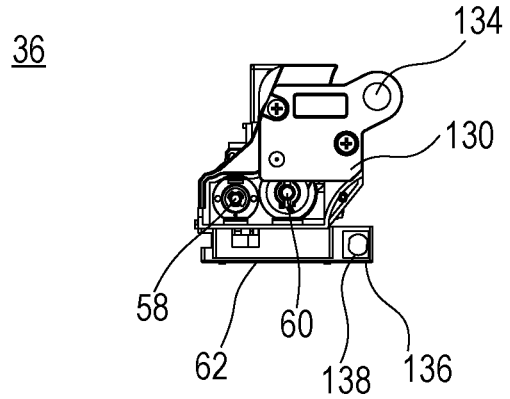
FIG. 9 is a front view of the development unit illustrated in FIG. 8.
Figure 10:
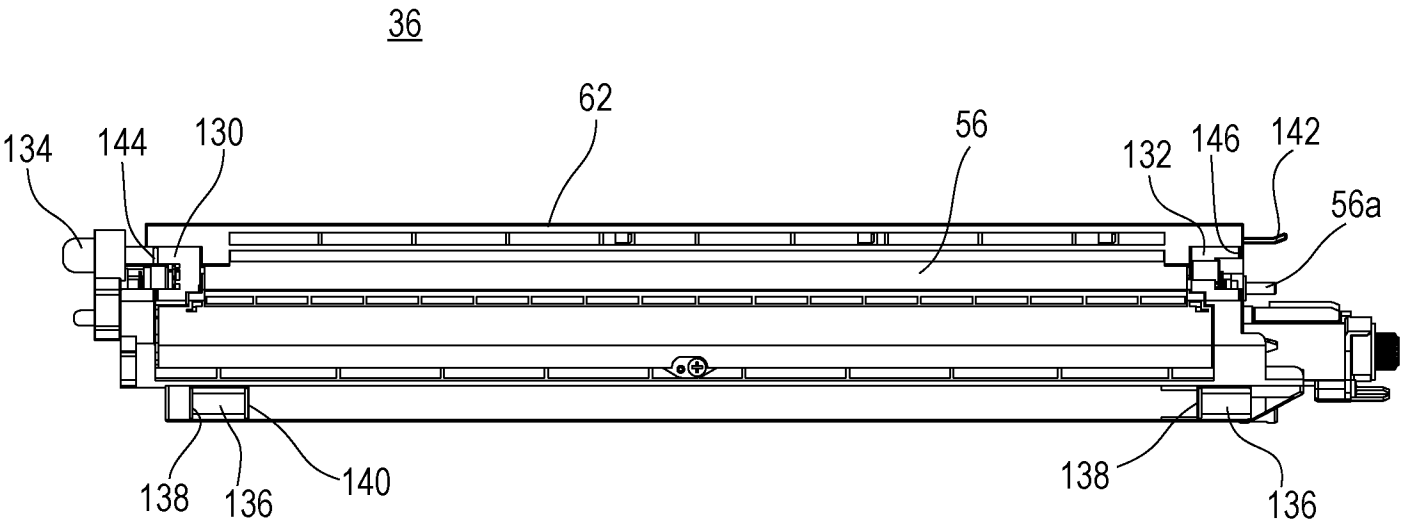
FIG. 10 is a right side view of the development unit illustrated in FIG. 8.

With reference FIG. 5 to FIG. 7 in addition to FIG. 4, as described above, the photoconductor unit 34 includes components such as the photoconductor drum 50, the charging device 52, and the cleaner unit 54. These components are integrally held by a photoconductor frame 110 in predetermined fixed positions. In this embodiment, the photoconductor drum 50 is disposed at an upper end portion of the surface (left side surface) facing the development unit 36 to extend in the front-rear direction. Here, the photoconductor drum 50 is held by the photoconductor frame 110 while having an upper left half exposed to the outside. The charging device 52 is disposed below the photoconductor drum 50. The cleaner unit 54 is disposed on the right of the photoconductor drum 50.

The photoconductor frame 110 includes a front wall 112 and a rear wall 114. Both end portions of a drum shaft 50*a* of the photoconductor drum 50 are rotatably supported by bearings disposed at the front wall 112 and the rear wall 114. The front end portion of the drum shaft 50*a* protrudes frontward from the front wall 112. The rear wall 114 has a protrusion protruding leftward from the upper portion. The protrusion has a rear receiving portion 116, into which the rear end portion of a roller shaft 56*a* of the development roller 56 is fitted. The front end portion of the drum shaft 50*a* and the rear receiving portion 116 serve as fitting portions that fix and integrate the photoconductor unit 34 to the development unit 36, together with a front receiving portion 134 and a rear end portion of the roller shaft 56*a*, which will be described later.

Guide pins 118 are disposed at lower end portions (end portions across from the photoconductor drum 50) on the surface (left surface) of the photoconductor frame 110 facing the development unit 36. The guide pins 118 have a cylindrical shape extending in the front-rear direction (axial direction of the photoconductor drum 50), and are disposed one at each of the front end portion and the rear end portion of the photoconductor frame 110. The guide pins 118 serve as assembly guides that guide the photoconductor unit 34 with respect to the development unit 36 to the assembly position, together with guide grooves 136 of the development housing 62, described below.

A lock portion 120, which is locked with a lock piece 142 of the development housing 62 described later, is disposed on the upper surface of the rear wall 114 of the photoconductor frame 110. The lock portion 120 has a triangular protrusion shape having a perpendicular rear surface and an inclined front surface. The lock portion 120 and the lock piece 142 serve as stopper portions that restrict rearward movement (detachment) of the photoconductor unit 34 relative to the development unit 36 to hold the units 34 and 36 in the assembly position.

A small protrusion 122, which extends in the front-rear direction, is disposed on the left side surface of the front wall 112 of the photoconductor frame 110. Together with small protrusions 144 and 146 of the development housing 62 described later, the small protrusion 122 serves as a bumper that prevents the development unit 36 from coming into contact with an image forming area of the photoconductor drum 50 during assembly of the process cartridge 10 (that is, during fitting of the fitting portions together to assemble the photoconductor unit 34 and the development unit 36 together).

With reference to FIG. 4 and FIG. 8 to FIG. 10, the development unit 36 includes components such as the development roller 56, a first transport member 58, a second transport member 60, and a doctor blade. These components are integrally held in predetermined fixed positions by the development housing 62. Simply speaking, the development housing 62 accommodates the first transport member 58 and the second transport member 60, while having both rotation axes arranged parallel to each other, and a developer containing a mixture of toner and a carrier. The first transport member 58 and the second transport member 60 are auger screws each having a helical blade on the outer circumferential surface of the cylindrical rotation shaft (screw shaft). The development housing 62 accommodates the development roller 56 above the second transport member 60. The development roller 56 is a magnet roller that functions as a developer carrier, and arranged parallel to the photoconductor drum 50 while having the outer circumferential surface being adjacent to the circumferential surface of the photoconductor drum 50. A distance (DSD) between the photoconductor drum 50 and the development roller 56 is set to, for example, 0.4 mm.

The development housing 62 includes a front frame 130 and a rear frame 132. Both end portions of the roller shaft 56*a* of the development roller 56 are rotatably supported by bearings disposed at the front frame 130 and the rear frame 132. Here, the rear end portion of the roller shaft 56*a* protrudes rearward from the rear frame 132. The front frame 130 has a protrusion protruding rightward from the upper portion. The protrusion includes the front receiving portion 134, into which the front end portion of the drum shaft 50*a* is fitted. As described above, the front receiving portion 134 and the rear end portion of the roller shaft 56*a* serve as fitting portions together with the front end portion of the drum shaft 50*a* and the rear receiving portion 116. The fitting portions, that is, the front receiving portion 134 and the front end portion of the drum shaft 50*a* are fitted to each other in the front-rear direction, and the rear end portion of the roller shaft 56*a*, and the rear receiving portion 116 are fitted to each other in the front-rear direction.

The development housing 62 also includes the guide grooves 136, which are open rightward and extend in the front-rear direction, at the lower end portions in the surfaces (right surface) facing the photoconductor unit 34. The guide grooves 136 are disposed the positions corresponding to the guide pins 118, that is, one at each of the front end portion and the rear end portion of the development housing 62. The guide grooves 136 are slidably engaged with the guide pins 118 in the front-rear direction. In this embodiment, the guide grooves 136 have their vertical dimensions gradually widened toward the open end (rightward). Thus, the guide pins 118 are rotatable in the circumferential direction while being engaged with the guide grooves 136. As described above, the guide grooves 136 are used as assembly guides together with the guide pins 118. The photoconductor unit 34 is slidable in the front-rear direction relative to the development unit 36 while the assembly guides (that is, the guide pins 118 and the guide grooves 136) are engaged together. The photoconductor unit 34 is also rotatable about the assembly guides used as an axis in directions in which the photoconductor drum 50 and the development roller 56 are moved toward and away from each other.

Disengagement stoppers 138 having a long-hole shape are formed at the front end portions of the guide grooves 136. The disengagement stoppers 138 prevent the assembly guides from being disengaged in the lateral direction when the fitting portions are fitted with insertion of the guide pins 118. The disengagement stoppers 138 can prevent the both units 34 and 36 from rotating. However, the disengagement stoppers 138 are preferably unloaded holes having a diameter larger than the outer diameter of the guide pins 118. This is because the positions of both units 34 and 36 are fixed with the fitting portions (shafts 50*a* and 56*a*), and both units 34 and 36 may fail to be assembled if having their positions fixed by also the disengagement stoppers 138. For example, to improve the positional accuracy of a coupling of the development unit 36 and a coupling of a cleaner of the photoconductor unit 34 with respect to a coupling of the apparatus body 12, the disengagement stoppers 138 are preferably unloaded holes to allow both units 34 and 36 to slightly rotate with respect to each other during insertion and removal of the process cartridge 10, and the apparatus body 12 preferably has a complete stopper to prevent both units 34 and 36 from rotating.

At the rear end portion of the front guide groove 136, an initial position definer 140 having a flat shape and defining the guide groove 136 is disposed. The initial position definer 140 defines the initial position of the assembly guides (and both units 34 and 36) in the front-rear direction during engagement of the assembly guides.

An elastically deformable lock piece 142 that protrudes rearward is disposed at an upper portion of the rear frame 132 of the development housing 62. The lock piece 142 has an engagement hole 142*a* engageable with the lock portion 120 of the photoconductor frame 110. The lock piece 142 also has, at its rear end portion, an inclined portion 142*b*, which is inclined obliquely upward. As described above, together with the lock portion 120, the lock piece 142 serves as a stopper portion that restricts rearward movement of the photoconductor unit 34 relative to the development unit 36. The stopper portions are automatically engaged through assembly of the process cartridge 10. The stopper portions are easily disengaged (released) by elastically deforming the lock piece 142. Here, the lock piece 142 having the inclined portion 142*b* allows a user to easily hook his/her finger thereon, and enhances the handleability for disengagement. The lock piece 142 integrally formed with the development housing 62 enables fixing of the positions of both units 34 and 36 in the front-rear direction without increasing the number of components.

Small protrusions 144 and 146 that extend vertically are disposed on the right side surfaces of the front frame 130 and the rear frame 132 of the development housing 62. As described above, together with the small protrusion 122 of the photoconductor frame 110, the small protrusions 144 and 146 serve as bumpers that prevent the development unit 36 from coming into contact with the image forming area of the photoconductor drum 50. The bumpers (small protrusions 122, 144, and 146) protrude by such a height that the photoconductor drum 50 and the development roller 56 are spaced 0.3 to 0.5 mm apart from each other.

Figure 12:
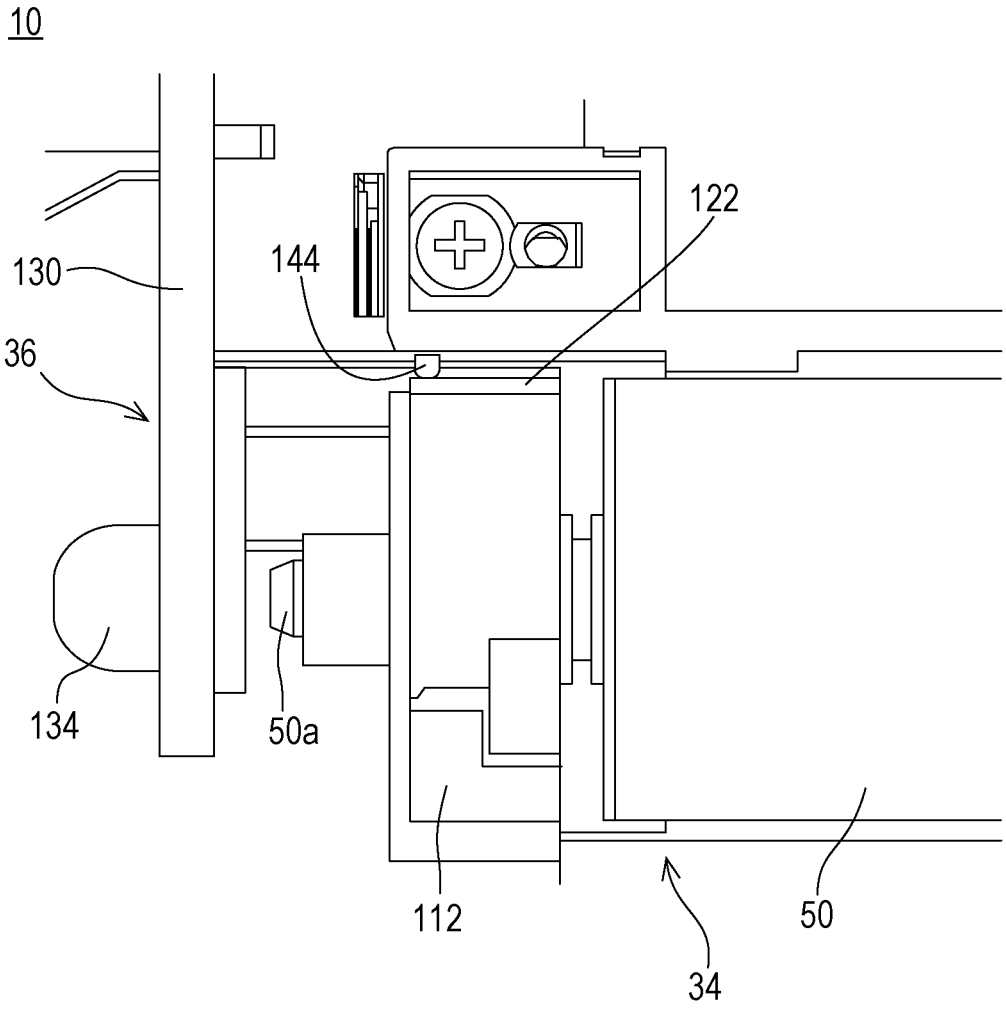
FIG. 12 illustrates a front end portion of the process cartridge during the operation in FIG. 11C.

When the photoconductor unit 34 is slid over the development unit 36, the small protrusion 144 of the front frame 130 comes into contact with the small protrusion 122 of the photoconductor frame 110 (refer to FIG. 12). On the other hand, the small protrusion 146 of the rear frame 132 comes into contact with a portion departing from the image forming area of the rear end portion of the photoconductor drum 50 (specifically, out of the cleaning blade included in the cleaner unit 54). The small protrusion 146 of the rear frame 132 in contact with the rear end portion of the photoconductor drum 50 enables size reduction of the development housing 62. Even when the photoconductor drum 50 is damaged by a contact with the small protrusion 146, the damaged portion disposed out of the image forming area neither affects the image quality, nor vibrates the cleaning blade to cause image defects. Here, the development housing 62 may be elongated rearward to prevent the development housing 62 and the photoconductor frame 110 from coming into contact with each other.

These bumpers in contact with each other move away from each other immediately before the fitting portions are fitted together. Specifically, when the fitting portions are fitted together, the small protrusion 144 of the front frame 130 is inserted into the gap between the front wall 112 and the photoconductor drum 50, and the small protrusion 146 of the rear frame 132 is inserted into the gap between the rear wall 114 and the photoconductor drum 50. This structure prevents a failure of fitting the fitting portions together (prevents an insertion failure) due to blockage of the bumpers in contact with each other. This structure also prevents an adverse effect on the distance DSD or a defect such as transmission of vibration during image formation.

Subsequently, with reference to FIG. 11A to FIG. 11D, the operation of assembling the photoconductor unit 34 and the development unit 36 into the process cartridge 10 will be described.

Figure 11A:
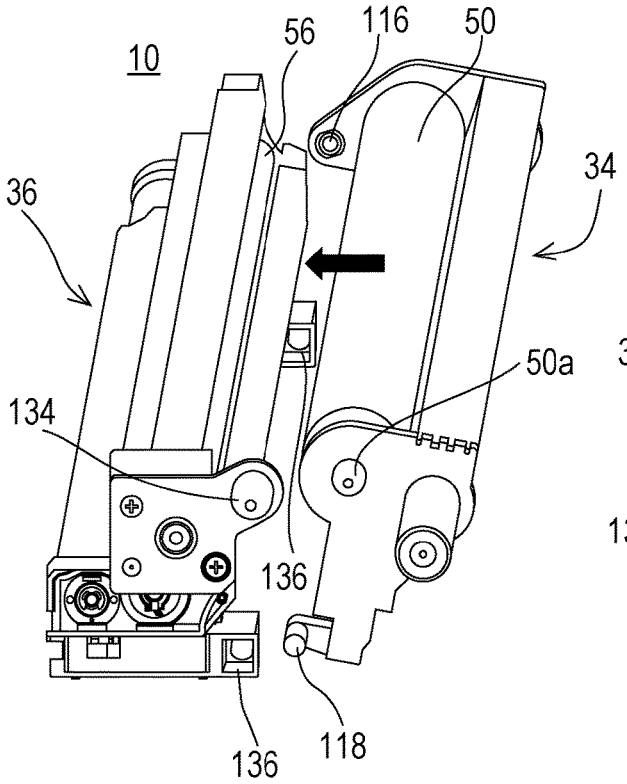
FIGS. 11A to 11D schematically illustrate operations for assembly of the development unit and the photoconductor unit together.

To assemble the photoconductor unit 34 and the development unit 36 together, first, as illustrated in FIG. 11A, a user brings the development unit 36 and the photoconductor unit 34 toward each other to engage the assembly guides together. Specifically, the guide pins 118 are engaged with the guide grooves 136. Here, the front guide groove 136 including the initial position definer 140 prevents misalignment between the photoconductor unit 34 and the development unit 36 in the front-rear direction. The assembly guides disposed at the ends across from the photoconductor drum 50 or away from the photoconductor drum 50 facilitate the user to visually recognize the assembly guides for engagement, and improve the handleability.

Figure 11B:
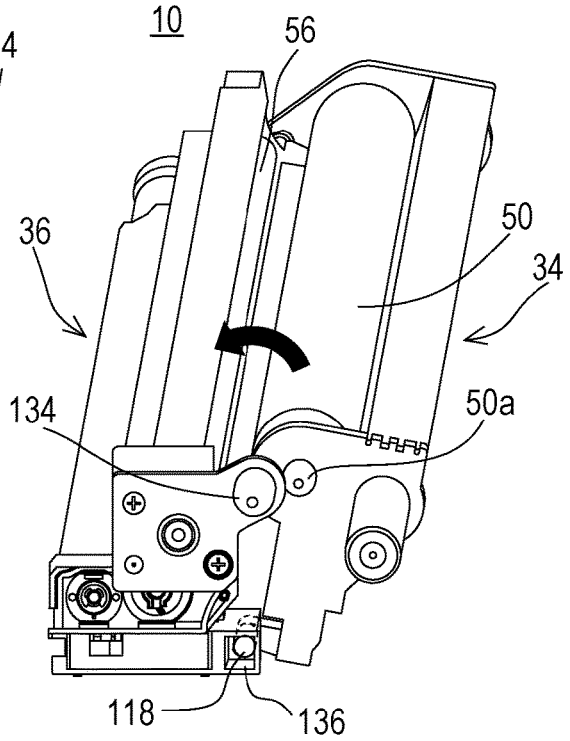

Now, as illustrated in FIG. 11B, the photoconductor unit 34 is rotated in the direction in which the photoconductor drum 50 is moved toward the development roller 56 using, as a hinged support, the guide grooves 136 and the guide pins 118 engaged together until the bumpers come into contact with each other (refer to FIG. 12). Here, the initial position definer 140 prevents misalignment in the front-rear direction, and the bumpers are appropriately in contact with each other. This structure thus prevents the photoconductor drum 50 from being erroneously damaged.

Figure 11C:
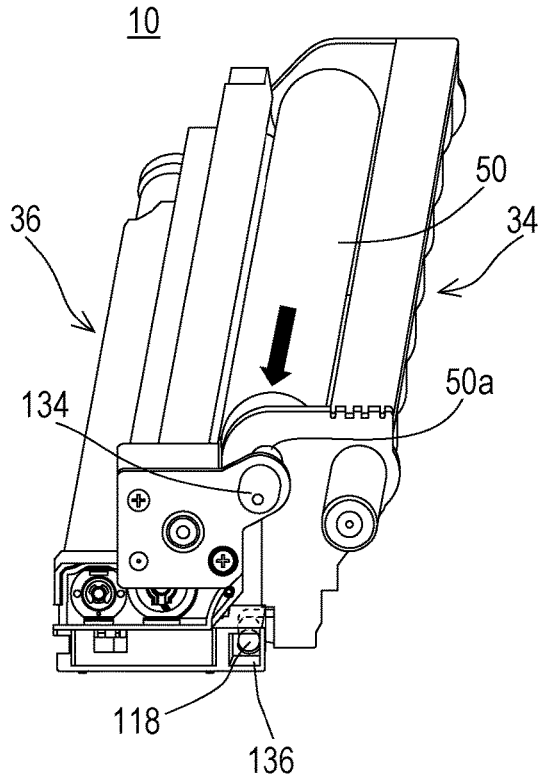

As illustrated in FIG. 11C, until the fitting portions are fitted together, that is, until the front end portion of the drum shaft 50*a* is inserted into the front receiving portion 134 and the rear end portion of the roller shaft 56*a* is inserted into the rear receiving portion 116, the photoconductor unit 34 is slid frontward over the development unit 36.

Figure 11D:
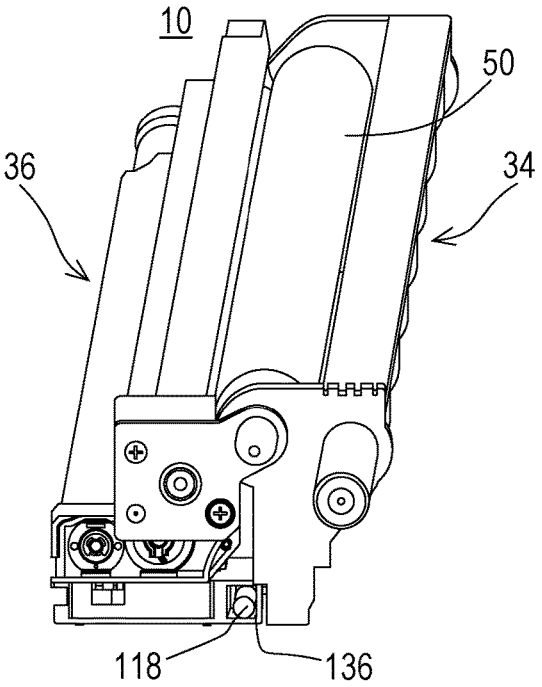
Figure 13:
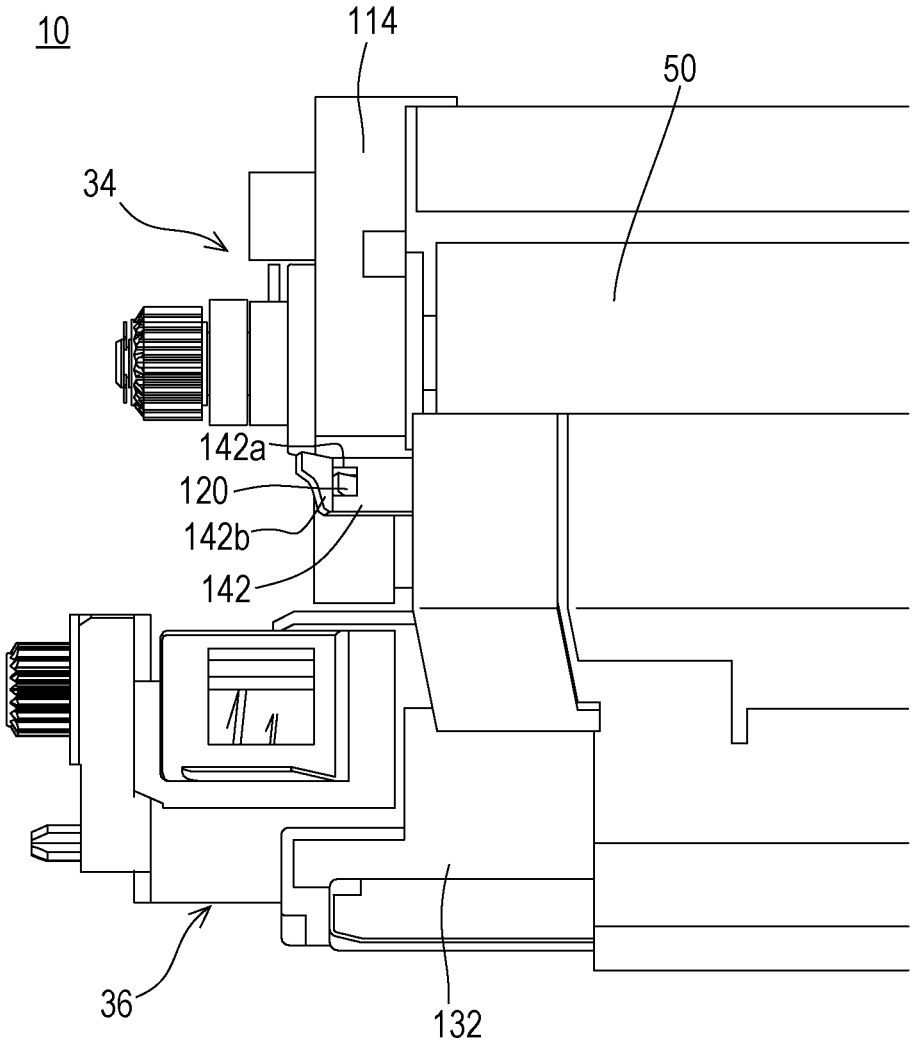
FIG. 13 illustrates a rear end portion of the process cartridge in the assembled state.

Then, as illustrated in FIG. 11D, the photoconductor unit 34 and the development unit 36 are assembled together while having their positions fixed. When the guide pins 118 are inserted into the disengagement stoppers 138, the assembly guides are prevented from being disengaged in the left-right direction, and both units 34 and 36 are prevented from rotating. As illustrated in FIG. 13, when the lock piece 142 is engaged with the lock portion 120, rearward movement (disengagement) of the photoconductor unit 34 relative to the development unit 36 is restricted.

As described above, the process cartridge 10 can be assembled with a simple operation by engaging the assembly guides together, rotating the photoconductor unit 34 relative to the development unit 36, and then sliding the photoconductor unit 34. In this assembled state, each of the distances DSD on the front side and the rear side can be determined by one component (front frame 130 or rear wall 114). Thus, the distance DSD can be stabilized with high accuracy. The assembly guides spaced apart from the photoconductor drum 50 improves the positioning accuracy of both units 34 and 36.

The process cartridge 10 can be easily disassembled into the photoconductor unit 34 and the development unit 36 with the operation reverse to the assembly. Specifically, the assembly guides may be disengaged by, while the stopper portions are disengaged with elastic deformation of the lock piece 142, sliding the photoconductor unit 34 rearward relative to the development unit 36, and rotating the photoconductor unit 34. Here, the assembly guides function as disassembly guides.

As described above, according to the first embodiment, the photoconductor unit 34 and the development unit 36 include assembly guides that guide themselves to the assembly position. Thus, the photoconductor unit 34 and the development unit 36 can be assembled and disassembled with a simple operation. Thus, the operation load borne by a user can be reduced.

In the above first embodiment, the photoconductor unit 34 is rotated relative to the development unit 36 with the assembly guides used as a hinged support, but may not necessarily be rotated. However, engaging the assembly guides first improves the handleability during assembly.

Second Embodiment

Subsequently, a process cartridge 10 according to a second embodiment of the present disclosure will be described. In the second embodiment, stopper portions of the photoconductor unit 34 and the development unit 36 have structures different from those in the first embodiment. The other portions are the same as those in the first embodiment, which are not or simply described.

Figure 14:
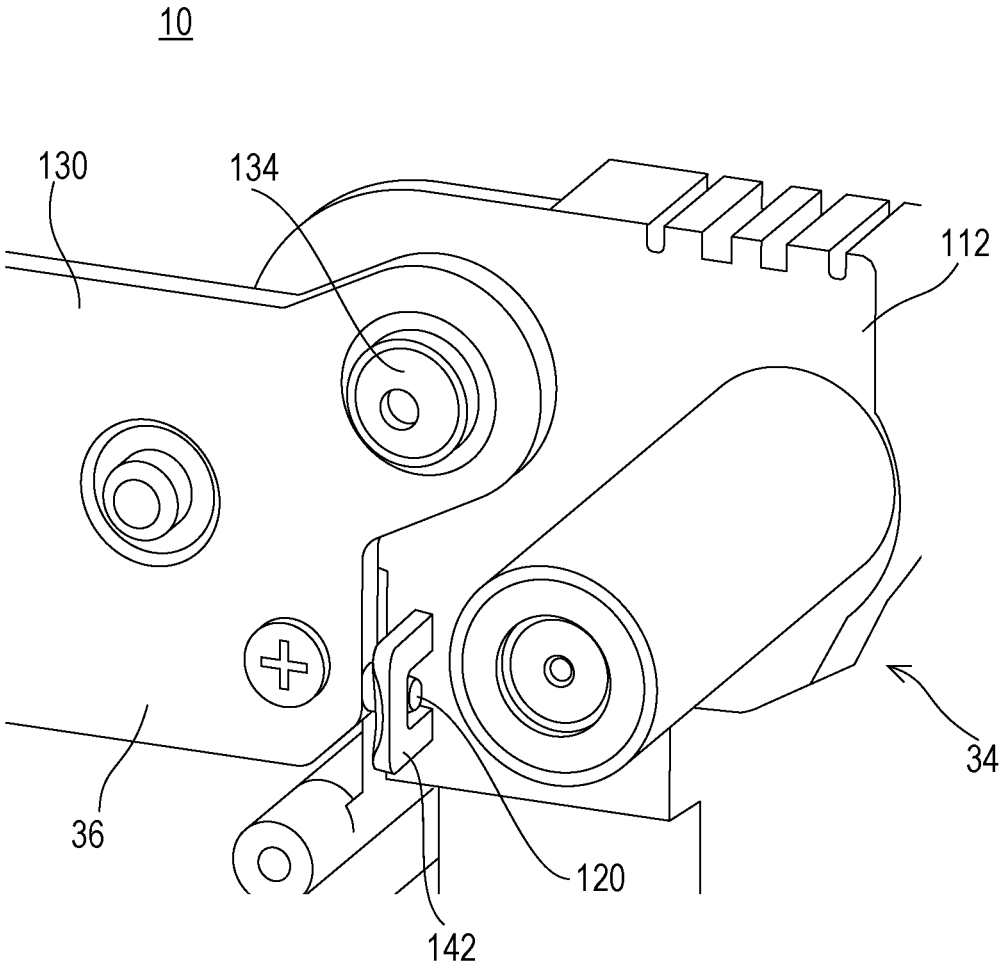
FIG. 14 illustrates a front end portion of a process cartridge according to a second embodiment of the present disclosure.

As illustrated in FIG. 14, in the second embodiment, units forming the lock portion 120 and the lock piece 142 are located opposite to those according to the first embodiment. Specifically, the lock portion 120 is disposed on the front frame 130 of the development unit 36, and the elastically deformable lock piece 142 is disposed on the front wall 112 of the photoconductor unit 34.

The second embodiment also has the same effects as those of the first embodiment. The photoconductor unit 34 and the development unit 36 can be assembled and disassembled with a simple operation, and reduce the load borne by a user.

In the above embodiments, a MFP including functions such as copier, scanner, printer, and other functions is described as an example of the image forming apparatus 100. Instead, the image forming apparatus 100 may be any of a copier, a facsimile, and a printer, or a MFP including at least two of these. The image forming apparatus 100 may be a monochrome image forming apparatus.

The above embodiments have described the image forming apparatus 100 that uses a binary developer containing toner and a carrier. The disclosure is, however, applicable to an image forming apparatus using a one-component developer. The structure of the process cartridge 10 (photoconductor unit 34 and development unit 36), particularly, the specific structures of the fitting portions, the assembly guides, the stopper portions, the bumpers, and other portions are not limited to the structures employed in the embodiments, but may be changed as appropriate.

The specific numerical values or specific shapes of the components described above are mere examples, and may be changed as appropriate in accordance with, for example, the specifications of products.

The present disclosure contains subject matter related to that disclosed in Japanese Priority Patent Application JP 2018-120156 filed in the Japan Patent Office on Jun. 25, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A process cartridge, comprising:

a photoconductor unit including a photoconductor drum; and a development unit including a development roller, assembled with the photoconductor unit while being allowed to be separated from the photoconductor unit, wherein the process cartridge is attached to or removed from an apparatus body of an image forming apparatus while the photoconductor unit and the development unit are assembled together, and wherein the photoconductor unit and the development unit include fitting portions fitted to each other in an axial direction of the photoconductor drum to fix positions of the photoconductor unit and the development unit and assemble the photoconductor unit and the development unit together, assembly guides engaged together while being slidable in the axial direction to guide the photoconductor unit and the development unit to an assembly position, and stopper portions that restrict the photoconductor unit and the development unit while allowing the photoconductor unit and the development unit to move relative to each other in the axial direction when the fitting portions are fitted to each other.

2. The process cartridge according to claim 1, wherein the assembly guides are rotatably engaged together, and wherein the photoconductor unit and the development unit are rotatable, while the assembly guides are engaged with each other, about the assembly guides used as an axis in directions in which the photoconductor drum and the development roller move toward and away from each other.

3. The process cartridge according to claim 1, wherein the assembly guides include a guide groove formed in either the photoconductor unit or the development unit to extend in the axial direction, and a guide pin formed in the other one of the photoconductor unit and the development unit to be fitted into the guide groove.

4. The process cartridge according to claim 1, wherein the assembly guides include a disengagement stopper that prevents, when the fitting portions are fitted to each other, the assembly guides from being disengaged in a direction perpendicular to the axial direction.

5. The process cartridge according to claim 1, wherein the assembly guides are disposed on surfaces of the photoconductor unit and the development unit opposing each other, at end portions across from the photoconductor drum.

6. The process cartridge according to claim 1, wherein the assembly guides include an initial position definer that defines an initial position in the axial direction to engage the assembly guides together.

7. The process cartridge according to claim 1, wherein the stopper portions include an elastically deformable lock piece disposed at either the photoconductor unit or the development unit, and a lock portion disposed at the other one of the photoconductor unit and the development unit to be engaged with the lock piece.

8. The process cartridge according to claim 1, further comprising:

bumpers that prevent the development unit from coming into contact with an image forming area of the photoconductor drum during an assembly of the photoconductor unit and the development unit.

9. The process cartridge according to claim 8, wherein the bumpers move away from each other immediately before the fitting portions are fitted to each other.

10. An image forming apparatus, comprising:

the process cartridge according to claim 1; and an apparatus body including a cartridge receiving portion to which the process cartridge is removably attached.

* * * * *